US006276337B1

(12) United States Patent
Minato

(10) Patent No.: US 6,276,337 B1
(45) Date of Patent: Aug. 21, 2001

(54) COMMON-RAIL FUEL-INJECTION SYSTEM

(75) Inventor: Akihiko Minato, Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/348,564

(22) Filed: Jul. 7, 1999

(30) Foreign Application Priority Data

Jul. 8, 1998 (JP) ..... 10-193459

(51) Int. Cl.[7] ..... F02M 51/00; F02D 41/14; F02D 41/38; F02D 41/40

(52) U.S. Cl. ..... 123/456; 123/486; 701/105

(58) Field of Search ..... 123/501, 467, 123/496, 357, 456, 488, 486, 458, 478, 490; 701/105

(56) References Cited

U.S. PATENT DOCUMENTS

| | | | | |
|---|---|---|---|---|
| 4,788,960 | * | 12/1988 | Oshizawa | 123/458 |
| 5,191,867 | * | 3/1993 | Glassey | 123/501 |
| 5,445,129 | * | 8/1995 | Barnes | 123/446 |
| 5,477,834 | * | 12/1995 | Yoshizu | 123/301 |
| 5,653,210 | * | 8/1997 | Fischer et al. | 123/501 |
| 5,711,277 | * | 1/1998 | Fuseya | 123/496 |
| 5,722,373 | * | 3/1998 | Paul et al. | 123/446 |
| 5,727,525 | * | 3/1998 | Tsuzuki | 123/447 |
| 5,778,852 | * | 7/1998 | Penteker | 123/359 |
| 5,848,581 | * | 12/1998 | Hirose et al. | 123/357 |
| 5,988,143 | * | 11/1999 | Dietz et al. | 123/458 |
| 6,053,150 | * | 4/2000 | Takahashi | 123/501 |
| 6,102,009 | * | 8/2000 | Nishiyama | 123/490 |
| 6,142,121 | * | 11/2000 | Nishimura et al. | 123/456 |

FOREIGN PATENT DOCUMENTS

| | | |
|---|---|---|
| 59-165858 | 9/1984 | (JP) . |
| 62-282164 | 12/1987 | (JP) . |
| 11101149 | 4/1999 | (JP) . |

* cited by examiner

*Primary Examiner*—Andrew M. Dolinar
*Assistant Examiner*—Arnold Castro
(74) *Attorney, Agent, or Firm*—Browdy and Neimark

(57) ABSTRACT

A common-rail fuel-injection system is disclosed for finding controlled variables such as an initial quantity of fuel injected in accordance with a start-delay time and adjusting the controlled variables to their desired value to thereby help ensure the reliable control and also the compensation in scattering of the initial fuel-injection characteristics. When selecting an initial quantity of fuel injected as the controlled variable of the initial injection, a desired, initial quantity $Qi_0$ of fuel injected is found on a lookup map C in accordance with the engine operating conditions, and a pull-in voltage Vp or current Ip is found on a lookup map D in compliance with the desired, initial quantity $Qi_0$ of fuel injected. An initial quantity Qi of fuel injected is found on a data, having been obtained previously, in compliance with a start-delay time T spanning from a timing the injector is applied with an instruction to initiate the fuel injection till a timing of the start of an actual fuel injection. The pull-in voltage Vp or current Ip is compensated by the difference method, based on a deflection between the desired initial quantity $Qi_0$ and the initial quantity Qi of fuel injected so as to make the initial quantity Qi conform with the desired, initial quantity $Qi_0$.

11 Claims, 7 Drawing Sheets

COMMON-RAIL FUEL-INJECTION SYSTEM

BACKGROUND OF THE INVENTION

1. Field of the Invention

The present invention relates to a common-rail fuel-injection system in which fuel supplied under high pressure from a common rail is injected under pressure into the combustion chambers of engines.

2. Description of the Prior Art

The various types of fuel-injection systems for engines include a common-rail fuel-injection system in which the fuel stored under high-pressure in the common rail is applied to the injectors, which are in turn actuated by making use of a part of the high-pressure fuel as a working fluid to thereby spray the fuel applied from the common rail into the combustion chambers out of discharge orifices formed at the distal ends of the injectors.

Referring to FIG. 5 where an example of a conventional common-rail fuel-injection system is illustrated schematically, a fuel feed pump 6 draws fuel from a fuel tank 4 through a fuel filter 5 and forces it under a preselected intake pressure to a high-pressure, fuel-supply pump 8 through a fuel line 7. The high-pressure, fuel-supply pump 8 is, for example, a fuel-supply plunger pump driven by the engine, which subjects the fuel to a high pressure determined depending on the engine operating conditions, and supplies the pressurized fuel into the common rail 2 through another fuel line 9. The fuel, thus supplied, is stored in the common rail 2 at the preselected high pressure and forced to the injectors 1 through injection lines 3 from the common rail 2. The engine illustrated is a six-cylinder engine. The injectors 1 are arranged in combustion chambers, one to each chamber, of a multi-cylinder engine, for example, a six-cylinder engine in FIG. 5.

Excess fuel from the high-pressure, fuel-supply pump 8 is allowed to flow back to the fuel tank 4 through a fuel-return line 10. The unconsumed fuel remaining in each injector 1 out of the fuel fed from the common rail 2 into the injectors 1 may return to the fuel tank 4 through a fuel-recovery line 11. The controller unit 12 is supplied with various signals from sensors monitoring the engine operating conditions, such as a crankshaft position sensor for detecting the engine rpm Ne, an accelerator pedal sensor for detecting the depression Ac of an accelerator pedal, a high-pressure fuel temperature sensor and the like. In addition, the sensors for monitoring the engine operating conditions include an engine coolant temperature sensor, an intake manifold pressure sensor and the like. The controller unit 12 is also supplied with a detected signal as to fuel pressure in common-rail 2, which is transmitted from a pressure sensor 13 installed in the common rail 2.

The controller unit 12 may regulate the fuel injection characteristics of the injectors 1, including the injection timing and the quantity of fuel injected, depending on the applied signals, so as to operate the engine with the optimum injection timing and quantity of fuel injected per cycle in conformity with the present engine operating conditions, thereby allowing the engine to operate as fuel-efficiently as possible. The quantity of fuel injected per cycle is determined by the combination of injection duration with the injection pressure of the fuel sprayed out of the injectors. The injection pressure is substantially equal to the common rail pressure controlled by operating a flow-rate control valve 14, which is to regulate the quantity of high-pressure fuel delivered to the common rail 2. In case the injection of fuel out of the injectors 1 consumes the fuel in the common rail 2 or it is required to alter the quantity of fuel injected, the controller unit 12 actuates the fuel flow-rate control valve 14, which in turn regulates the quantity of fuel delivered from the high-pressure, fuel-supply pump 8 to the common rail 2 whereby the common rail pressure returns to the preselected fuel pressure.

Referring to FIG. 6, the injector 1 is comprised of an injector body 21, and an injection nozzle 22 mounted to the injector body 21 and formed therein with an axial bore 23 in which a needle value 24 is fitted for sliding movement. The high-pressure fuel applied to the individual injector 1 from the common rail 2 through the associated injection line 3 fills fuel passages 31, 32 and a fuel pocket 33 formed in the injector body 21. The high-pressure fuel further reaches around the needle valve 24 in the axial bore 23. Therefore, the instant the needle valve 24 is lifted to open discharge orifices 25 at the distal end of the injection nozzle 22, the fuel is injected out of the discharge orifices 25 into the combustion chamber. Provided at the distal end of the injection nozzle 22 is a fuel sac 26 to which are opened the discharge orifices 25. The needle valve 24 has a tapered end 27 that moves upwards off or downwards against a tapered surface 28 inside the injection nozzle 22 whereby the fuel injection starts or ceases.

The injector 1 is provided with a needle-valve lift mechanism of pressure-control chamber type in order to adjust the lift of the needle valve 24. The high-pressure fuel fed from the common rail 2 is partly admitted into a pressure-control chamber 40, which is formed inside the injector 1, past a fuel passage 35 branching away from the fuel passage 31 and a fuel passage 36 reduced in cross-sectioned area. The injector 1 has at the head section thereof a solenoid-operated valve 15, which constitutes an electronically-operated actuator to control the outflow of working fluid, or fuel from the pressure-control chamber 40. The controller unit 12 makes the solenoid-operated valve 15 energize in compliance with the engine operating conditions, thereby adjusting the hydraulic pressure of the working fluid in the pressure-control chamber 40 to either the high pressure of the admitted high-pressure fuel or a low pressure released partially in the pressure-control chamber 40. A control signal issued from the controller unit 12 is an exciting signal applied to a solenoid 38 of solenoid-operated valve 15.

The solenoid-operated valve 15 includes an armature 39 having at its end a valve body 42 for opening and closing an egress of a fuel leakage path 41. On energizing solenoid 38, the armature 39 rises to open valve body 42 whereby the fuel in the pressure-control chamber 40 is allowed to discharge, resulting in relieving the high pressure of the fuel in the pressure-control chamber 40. Although the valve body 42 is explained in the type of opening and closing the egress of the fuel leakage path 41, it may be alternatively made of a poppet valve composed of a valve stem extending through the fuel leakage path 41, and a tapered valve body provided at the end of the valve stem and having a valve face to make engagement with a valve seat at an ingress of the fuel leakage path 41.

A control piston 44 is arranged for axial linear movement in an axial recess 43 formed in the injector body 21 of the injector 1. Although the control piston 44 shown in the figure is formed integrally with the needle valve 24, the control piston may be formed separately from the needle valve and combined therewith such that they may be energized so as to follow one another. When the solenoid-operated valve 15 is energized to cause the fuel pressure inside the pressure-control chamber 40 to decrease, the consequent force, acting on the control piston 44 to push it downward, is made less than the fuel pressure acting on both a tapered surface 34 exposed to the pocket 33 and the distal end of the needle valve 24, whereby the control valve 44 moves upwards. As a result, the needle valve 24 lifts to allow the fuel to spray out of the discharge orifices 25. The quantity of fuel injected per cycle is defined dependent on the fuel pressure in the fuel passages and both the amount and duration of lift of the needle valve 24.

The common-rail fuel-injection system, or the pressure-balance, fuel-injection system, as described just above is disclosed in, for example, Japanese Patent Laid-Open Nos. 165858/1984 and 282164/1987, in in which the fuel supplied under pressure from the common rail 2 to the injectors 1 is partly applied to the chamber 40 in the injectors 1, acting as the working fluid to lift the needle valve 24 to thereby inject the fuel out of the discharge orifices 25.

It is well-known to those skilled in the art that the engine operating conditions in diesel engines are largely affected by the initial fuel-injection characteristics of the injectors 1, namely, the initial quantity of fuel injected, the initial injection rating and the rate of change thereof. For example, a large initial quantity of fuel injected causes a large quantity of fuel firing at the initiation of combustion with the heat release rate being increased whereby the diesel engines are apt to decline in noise control and exhaust gas performance. Not only the firing conditions at the initiation of combustion in the combustion chambers but the engine noise and the exhaust gas performance are affected by the time-base derivative of the initial quantity of fuel injected, or the initial injection rating, and the time-base rate of change of the injection rating. Nevertheless, no inexpensive, simple mechanism has been developed to determine how much the quantity of fuel injected, the injection rating and the rate of change thereof are at the actual initial fuel-injection. This causes such major problem that it is very hard to control reliably the injection rating and the like in most commercially available cars.

In recent years measuring means for the quantity of fuel injected out of the injector, as shown schematically in FIG. 7, has been developed, which is composed of a micro-turbine 50 arranged in a passage inside an inlet connector communicating the injection body 21 with the injection line 3 of the injector 1, and an optical sensor mechanism for detecting the rotational speed of the micro-turbine 50. Moving blades 51 are partially exposed in the fuel passage to thereby be turned by the fuel flowing through the fuel passage. Rotation of the moving blade 51 of the micro-turbine 50 block intermittently a light beam 52 from a light source to thereby output pulses of light, which are received at a detector. The peripheral velocity V of the moving blades 51 of the micro-turbine 50 at the blade tips is given by $V=2\pi nR$, where n is the rotational speed of the turbine, and R is the radius of the turbine. Because the peripheral velocity V is equal to the mean velocity of flow of the fluid, the flow rate of fuel may be obtained by measuring the rotational speed n over a preselected length of time. Moreover, the injection rating may be found by the differential of the flow rate of fuel with respect to time.

Nevertheless, the micro-turbine is of an extremely miniaturized turbine and, therefore, it is very hard to help ensure the accuracy in manufacture and the precision of measurement. Moreover, the optical sensor employed is inevitably expensive. In addition, the micro-turbine 50 disposed in the high-pressure fuel passages creates a flow resistance opposing the flow of fuel, resulting in probably affecting the fuel-injection characteristics.

Consequently, it is expected to develop the fuel-injection system in which the information as to the controlled variables of the fuel injection such as the quantity of fuel injected, the fuel-injection rating and the rate of change thereof at the early portion of the fuel injection may be obtained with the controller computing the detected results from the existing sensors for the engine operating conditions, with no need of additional measuring means, thereby feedback controlling the controlled variables of the fuel injection at the early portion of the fuel injection, or at the initial injection. Moreover, much attention has been given to the subject in which, even if the controlled variables of the fuel injection at the initial injection differ for each injector owing to differences in the fuel-injection characteristics for the individual injectors, the controlled variables of the fuel injection may be detected at every injector so that each of the injectors, may be subjected to the individual feedback control.

SUMMARY OF THE INVENTION

The present invention has for its primary object to provide a common-rail fuel-injection system that detects controlled variables of fuel injection at an initial injection at every injector to feedback control individually the controlled variables at the initial injection for each of the injectors, thereby helping ensure an arbitrary and reliable fuel injection with a resulting steady engine performance. The common-rail fuel-injection system of this invention also makes it possible to exclude the influence of the difference between the fuel-injection characteristics of the individual injectors to thereby allow a relatively wide acceptable tolerance in the manufacture of the common-rail fuel-injection system, resulting in reduction in production cost.

The present invention is concerned with a common-rail fuel-injection system comprising injectors for spraying fuel into combustion chambers of an engine, a common rail storing therein the fuel to be supplied to the injectors, a high-pressure fuel pump for delivery of the fuel to the common rail, detecting means for monitoring engine operating conditions, and a controller unit for regulating fuel injection out of the injectors in compliance with signals transmitted from the detecting means, wherein the controller unit stores therein mapped data of a correlation defined previously between a controlled variable of the fuel injection at an initial injection and a start-delay time that spans from a time when any one of the injectors is supplied with an instruction to initiate the fuel injection to a time when an actual fuel injection starts at the injector, finding on the mapped data the controlled variable of the fuel injection at the initial injection in compliance with the start-delay time, and finding a desired, controlled variable of the fuel injection at the initial injection dependent on the signals, whereby the fuel injection from the injector is controlled so as to make the controlled variable of the fuel injection conform to the desired, controlled variable of the fuel injection.

While the controller unit calculates the desired, controlled variables of the fuel injection at the initial fuel injection in compliance with signals transmitted from the detecting means, there is a fixed correlation between the controlled variables of the fuel injection at the initial injection and the start-delay time that spans from the time when any one of the injectors is supplied with the instruction to initiate the fuel injection to the time when an actual fuel injection starts at the injector. The controller unit stores therein mapped data of the correlation defined previously, and finds on the mapped data the controlled variables of the fuel injection at the initial injection in compliance with the start-delay time. The controller unit controls the fuel injection from the injector so as to make the consequent controlled variables of the fuel injection conform with the desired, controlled variables of the fuel injection. Because the start-delay time may be determined with the common-rail pressure transmitted from the pressure sensor, which has been conventionally equipped in the common-rail fuel-injection system, the controlled variables of fuel injection at the initial injection can be found on the first mapped data. Consequently, when the desired, controlled variables of fuel injection undergo changes as the engine operating conditions vary, the controlled variables of the fuel injection may be feedback controlled, following the changes. Moreover, differences in the initial fuel-injection characteristics for between injectors may be compensated to provide the desired initial fuel-injection characteristics.

According to one aspect of the present invention, a common-rail fuel-injection system is disclosed in which the controlled variable and the desired, controlled variable of the fuel injection at the initial injection are an initial quantity of fuel injected and a desired, initial quantity of fuel injected, respectively. As an alternative, the controlled variable and the desired, controlled variable of the fuel injection at the initial injection are an initial injection rating and a desired, initial injection rating, respectively. Moreover, the controlled variable and the desired, controlled variable of the fuel injection at the initial injection alternatively are a rate of change of the initial injection rating and a desired rate of change of the initial injection rating, respectively.

According to another aspect of the present invention, a common-rail fuel-injection system is disclosed in which the start-delay time is determined by a correlation that is defined previously between a fuel pressure in the common rail before a pressure drop owing to the fuel injection and a time when the fuel pressure in the common rail starts descending.

According to a further other aspect of the present invention, a common-rail fuel-injection system is disclosed in which the time when the fuel pressure in the common rail starts descending is found, on a graphic representation showing a correlation between a length of time from the start till the end of the fuel injection and the fuel pressure in the common rail during the length of time, at a time-coordinate where an approximate descending straight line of the common-rail fuel pressure falling owing to the fuel injection intersects with an approximate line of the common-rail fuel pressure before the start of common-rail fuel pressure drop. As an alternative, the time when the fuel pressure in the common rail starts descending may be found at a time-coordinate where a deflection in pressure between the approximate descending straight line of the common-rail fuel pressure falling owing to the fuel injection and the varying curve of the common-rail fuel pressure becomes maximal.

In another aspect of the present invention, a common-rail fuel-injection system is disclosed, wherein the injectors each includes a balance chamber applied with a part of the fuel fed from the common rail, a needle valve movable upward and downward, depending on a hydraulic action of the fuel in the balance chamber, to thereby open and close discharge orifices at a distal end of the injector, a valve for allowing the fuel to discharge out of the balance chamber thereby resulting in relieving the fuel pressure in the balance chamber, and an actuator for driving the valve, and wherein the actuator is energized with an exciting signal responding to a command pulse issued from the controller unit to instruct the start of the fuel injection.

In another aspect of the present invention, a common-rail fuel-injection system is disclosed wherein the actuator is composed of an electromagnetic solenoid or a piezoelectric element, the exciting signal to operate the actuator is any one of an electric current and a voltage applied to the solenoid or a voltage applied to the piezoelectric element, and the controller unit stores therein second mapped data of a correlation defined previously among the common-rail fuel pressure, the desired, controlled variable of the fuel injection at the initial fuel injection and the current or voltage, whereby the current or voltage is calculated on the second mapped data in compliance with the common-rail fuel pressure and the desired, controlled variable of the fuel injection.

In another aspect of the present invention, the controller unit compensates the current or the voltage, which is found by calculation on the second mapped data, based on a deflection between the desired, initial controlled variable at the initial fuel injection and the initial controlled variable at the initial fuel injection found on the mapped data in compliance with the start-delay time. The current or voltage to be applied to the actuator in the injector is adjusted so as to make the initial controlled variables of the fuel injection conform to the desired, initial controlled variables of the fuel injection. That is to say, in case the controlled variables of the fuel injection such as the initial quantity of fuel injected, the initial injection rating and the rate of change of the initial injection rating are less, the controller unit makes the current or the voltage increase, thereby advancing the relief of the fuel pressure out of the balance chamber, which in turn increase the speed of lift of the needle valve, with a resulting reduction in the start-delay time of the fuel injection in the injector.

In another aspect of the present invention, the controller unit stores therein third mapped data of a correlation defined previously among a desired quantity of fuel injected, which is found in accordance with the signals from the detecting means, the common-rail fuel pressure, and one of the current and voltage and a pulse width of the command pulse, whereby the command pulse width is calculated on the third mapped data in compliance with the common-rail fuel pressure and any one of the current and voltage found on the second mapped data, to thereby achieve the desired quantity of fuel injected.

The controller unit finds, on the basis of the signals from the detecting means, the desired, initial controlled variables of the fuel injection such as the desired quantity of fuel injected at the initial fuel injection, the desired injection rating, or the rate of change of the desired injection rating, and then determines the deflection between the desired, initial controlled variables and the actual, initial controlled variables of the fuel injection, which are found based on the start-delay time. The controller unit further regulates the fuel injection of the injector on the basis of the deflection such that the actual, initial controlled variables of the fuel injection are made to conform to the desired, initial controlled variables, and thus the feedback control may be achieved by following the changes of the desired, controlled variables of the fuel injection owing to the variations of the engine operating conditions. Accordingly, the present invention makes it possible to select adequately the initial quantity of fuel injected, the initial injection rating or the rate of change of the injection rating, and also to improve the reliability of the fuel injection with the high engine performance. Moreover, even if the initial quantity of fuel injected differs for every injector due to the scattering in the initial fuel-injection characteristics, the controller unit may compensate differences in the initial fuel-injection characteristics thereby to keep the preselected characteristics in the initial injection rating. As a result, the common-rail fuel-injection system of this invention allows tolerances the wide acceptable tolerance in the manufacture of the common-rail fuel-injection system, resulting in reduction in production cost.

Other objects and features of the present invention will be more apparent to those skilled in the art on consideration of the accompanying drawings and following specification wherein are disclosed preferred embodiments of the invention with the understanding that such variations, modifications and elimination of parts may be made therein as fall within the scope of the appended claims without departing from the spirit of the invention.

DESCRIPTION OF THE PREFERRED EMBODIMENTS

Figure 5:
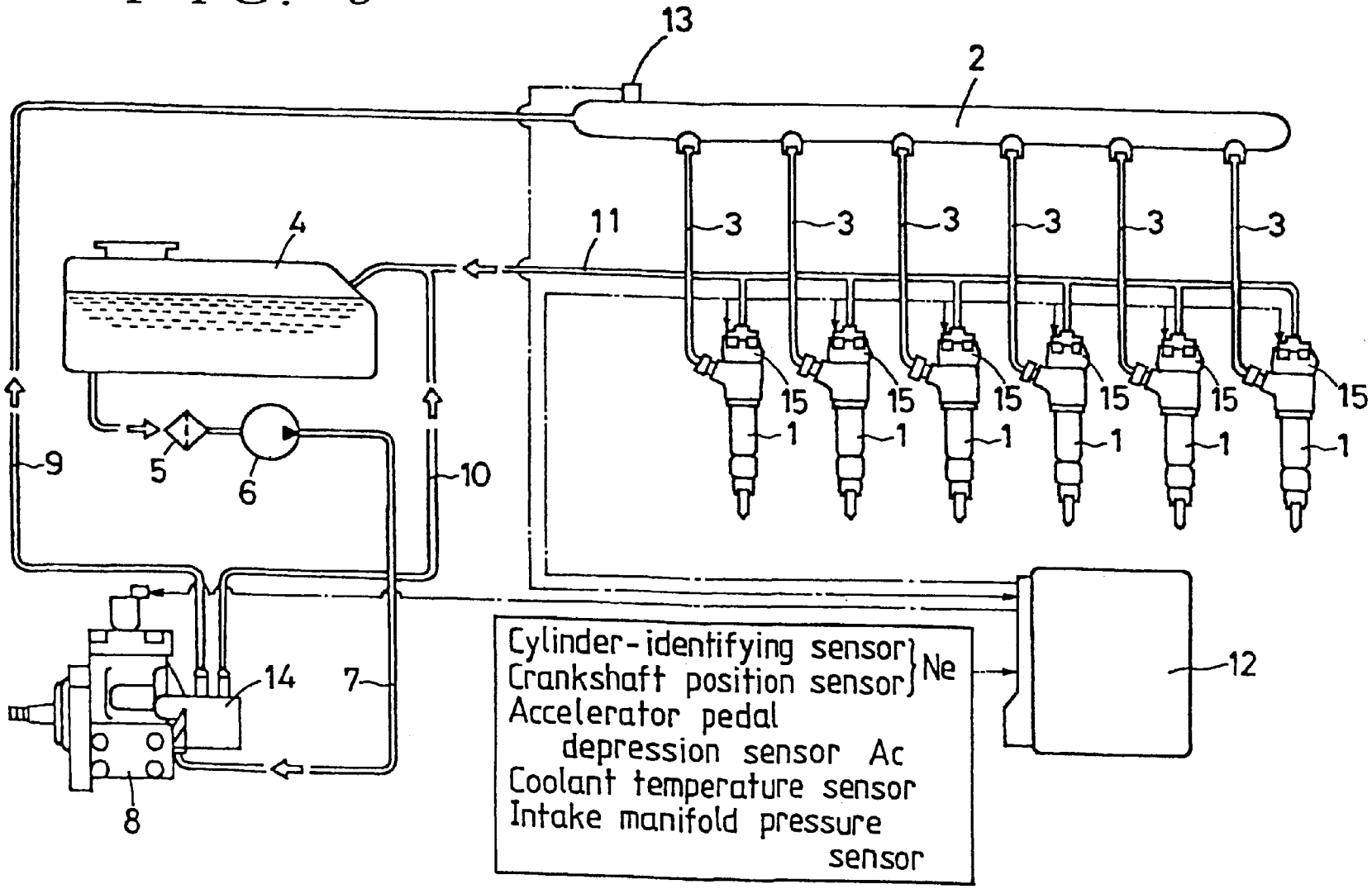
FIG. 5 is a schematic illustration of an arrangement of a conventional common-rail fuel-injection system.
Figure 6:
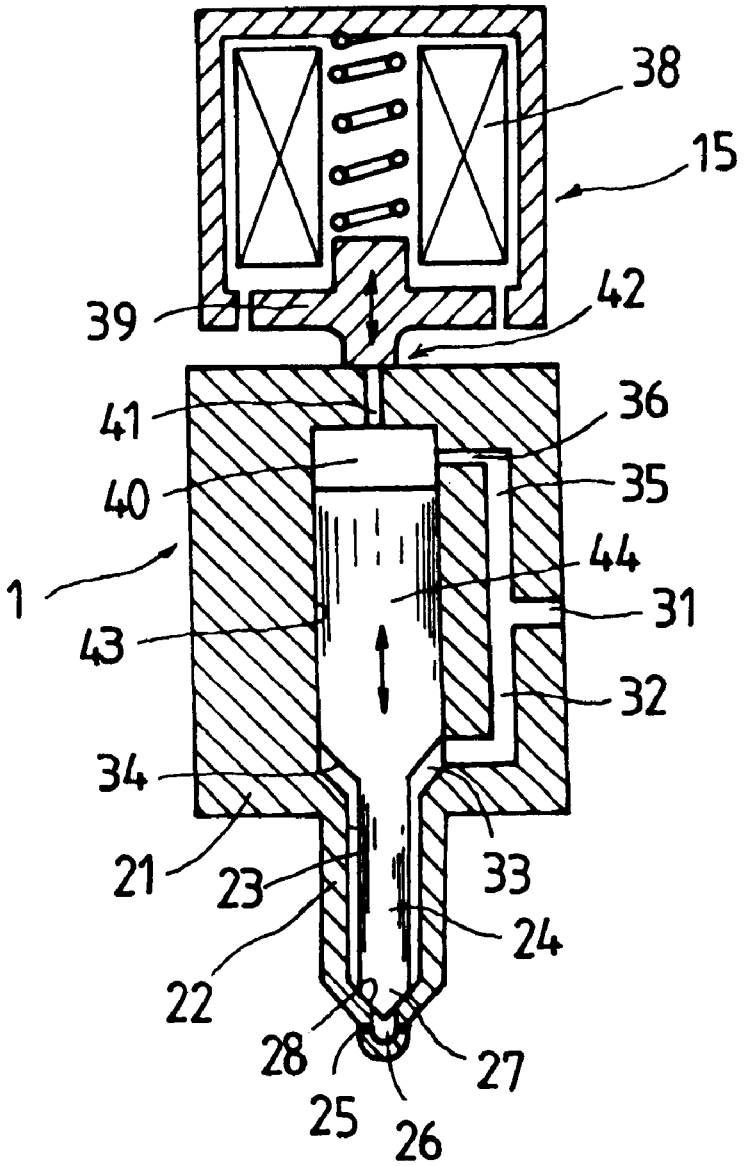
FIG. 6 is a schematic illustration of an injector used in the conventional common-rail fuel-injection system in FIG. 5.
Figure 7:
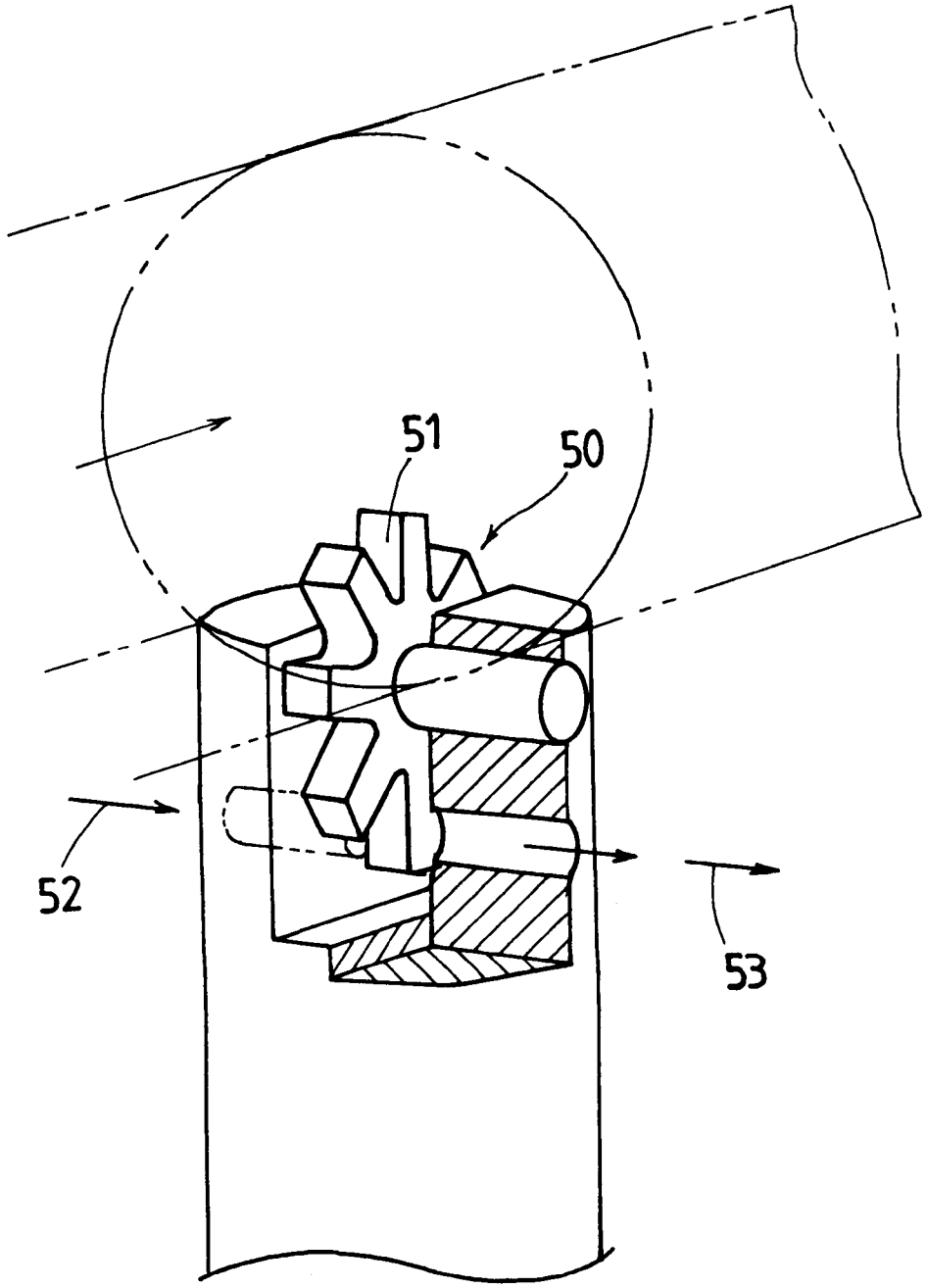
FIG. 7 is a schematic perspective view showing essential parts of a measuring means for the quantity of fuel, composed of a micro-turbine and an optical sensor mechanism.

A preferred embodiment of a common-rail fuel-injection system for engines according to the present invention will be explained in detail hereinafter with reference to FIGS. 1 to 4. The common-rail fuel-injection system as described above in connection with FIGS. 5 and 6 is substantially applicable to that according to the present invention. To that extent, the previous description will be applicable. The following equation applies for the common-rail fuel-injection system constructed as shown in FIGS. 5 and 6, $$(A_{nb} - A_{nsh}) \cdot (P_{cr} - P_{cc}) - A_{nsh} \cdot P_{cc} - F_s = 0 \qquad \text{Eq. [1]}$$

$$A_{nb} = \frac{\pi}{4} \cdot D_{nb}^2$$

$$A_{nsh} = \frac{\pi}{4} \cdot D_{nsh}^2$$

Dnb represents the outermost diameter of the needle valve

Dnsh is the diameter of the valve seat

Pcr is the common rail pressure

Pcc is the fuel pressure in the pressure control chamber

Fs is a preset force of the needle valve spring

Let (Pcr−Pcc) be designated by ΔP, Eq. [1] may be written as $$\Delta P = \frac{1}{A_{nb}} \cdot (A_{nsh} \cdot P_{cr} + F_s) \qquad \text{Eq. [2]}$$

On the other hand, a start-delay time spanning from the beginning of a command pulse conduction to the start of an actual fuel injection out of discharge orifices of the injector is designated by the symbol T. Now assuming that a pressure drop rate is constant, Eq. [2] may be theoretically written as $$\frac{dP_{cc}}{dt} = \frac{1}{T \cdot A_{nb}} \cdot (A_{nsh} \cdot P_{cr} + F_s) \qquad \text{Eq. [3]}$$

In connection with the pressure control chamber 40, the equation of continuity before the opening of the needle valve 24 may be expressed as the following equation. That is to say, the equation of continuity of the fluid in the pressure control chamber is defined as a difference in the quantity of fuel between the inflow through the associated injection line 3 and the fuel passages 35, 36 from the common rail 2 and the outflow through the fuel leakage path 41 and, therefore, the flowing Eq. [4] may be written $$\frac{dP_{cc}}{dt} = \frac{K}{V_{cc}}\left(\mu_{ex} \cdot A_{ex} \cdot \sqrt{\frac{2 \cdot (P_{cc} - P_b)}{\rho}} - \mu_{in} \cdot A_{in} \cdot \sqrt{\frac{2 \cdot (P_{cr} - P_{cc})}{\rho}}\right) \qquad \text{Eq. [4]}$$

$\mu$ in represents the flow coefficient at the ingress of the pressure control chamber A in is the opening area at the ingress of the pressure control chamber $\mu$ ex is the flow coefficient at the egress of the pressure control chamber Aex=f(Xc) is the opening area at the egress of the pressure control chamber ρ is the density of fuel Xc is the lift of the actuator-operated valve Pb is the back pressure Vcc is the volume of the pressure control chamber K is the volume modulus.

The above Eq. [3] and Eq. [4] combine to yield $$\mu_{ex} \cdot A_{ex} \cdot \sqrt{\frac{2 \cdot (P_{cc} - P_b)}{\rho}} - \mu_{in} \cdot A_{in} \cdot \sqrt{\frac{2 \cdot (P_{cr} - P_{cc})}{\rho}} = \frac{V_{cc}}{K \cdot T \cdot A_{nb}} \cdot (A_{nsh} \cdot P_{cr} + F_s) \qquad \text{Eq. [5]}$$

In the equation of continuity with regard to the pressure control chamber after the opening of the needle valve 24, now assuming that the volume compression is sufficiently small to be considered negligible, the speed of lift of the needle valve (dx/dt) may be expressed by $$\frac{dx_n}{dt} = \frac{1}{A_{nb}} \cdot \left(\mu_{ex} \cdot A_{ex} \cdot \sqrt{\frac{2 \cdot (P_{cc} - P_b)}{\rho}} - \mu_{in} \cdot A_{in} \cdot \sqrt{\frac{2 \cdot (P_{cr} - P_{cc})}{\rho}}\right) \qquad \text{Eq. [6]}$$

Xn is the lift of the needle valve

The above Eq. [5] and Eq. [6] combine to yield $$\frac{dx_n}{dt} = \frac{V_{cc}}{K \cdot T \cdot A_{nb}^2} \cdot (A_{nsh} \cdot P_{cr} + F_s) \quad \text{Eq. [7]}$$

Moreover, in connection with the sac, now assuming that the volume compression is sufficiently small to be considered negligible, the equation of continuity may be expressed as the following Eq. [8]

$$\mu'_{in} \cdot A'_{in} \cdot \sqrt{\frac{2 \cdot (P_{cr} - P_s)}{\rho}} - \mu'_{ex} \cdot A'_{ex} \cdot \sqrt{\frac{2 \cdot (P_s - P_b)}{\rho}} + A_{ns} \cdot \frac{dx_n}{dt} = 0 \quad \text{Eq. [8]}$$

$\mu'$ in represents the flow coefficient at the ingress of the fuel sac

A' in is the opening area at the ingress of the sac $\mu'$ ex is th flow coefficient at the egress of the sac $$A'_{ex} = \frac{\pi}{4} \cdot D_{nh}^2 \cdot n$$

is the opening area at the egress of the sac

Dns is the inner diameter of the sac

Dnh is the diameter of one discharge orifice n is the number of discharge orifices Meanwhile the second term of the left part in Eq. [8] represents the flow rate per preset length of time discharged out of the discharge orifices of the injection nozzle 22, namely, the injection rating. Solving the Eq. [8] in the term of the injection rating yields $$\frac{dG}{dt} = \mu'_{ex} \cdot A'_{ex} \cdot \sqrt{\frac{2 \cdot (P_s - P_b)}{\rho}} = \mu'_{in} \cdot A'_{in} \cdot \sqrt{\frac{2 \cdot (P_{cr} - P_s)}{\rho}} + A_{ns} \cdot \frac{dx_n}{dt} \quad \text{Eq. [9]}$$

Here, the opening area A' in at the ingress of the fuel sac 26 is the function of the amount of lift of the needle valve 24. The function may be given by the following Eq. [10], in which the symbol θ is the valve face angle of the tapered end 27 of the needle valve 24, $$A'_{in} = \pi \cdot D_{ns} \cdot \sin\left(\frac{\theta}{2}\right) \cdot x_n \quad \text{Eq. [10]}$$

When defining the initial quantity of fuel injected as a quantity of fuel injected for a length of time spanning from the start of the injection to a time t and thinking of an opening area at the ingress of the sac 26 at the time t as the opening area representative of the opening area A' in at the ingress of the sac 26, the Eq. [10] may be written as $$A'_{in} = \pi \cdot D_{ns} \cdot \sin\left(\frac{\theta}{2}\right) \cdot \frac{dx_n}{dt} \cdot t \quad \text{Eq. [11]}$$

The Eq. [7] and Eq. [11] combine with the Eq. [9] to yield $$\frac{dG}{dt} = \left(\mu'_{in} \cdot \pi \cdot D_{ns} \cdot t \cdot \sin\left(\frac{\theta}{2}\right) \cdot \sqrt{\frac{2 \cdot P_{cr}}{\rho}} + A_{ns}\right) \cdot \frac{V_{cc}}{K \cdot T \cdot A_{nb}^2} \cdot (A_{nsh} \cdot P_{cr} + F_s) \quad \text{Eq. [12]}$$

The common-rail pressure substantially represents the term about the pressure inside the square root, because the fuel sac 26 is relatively less in pressure and in which the common rail pressure is dominant. The injection rating obtained by the Eq. [12] corresponds to the mean injection rating in the time interval spanning from the start of the injection to the time t. Therefore, the injection rating may be written as $$Q_i = \frac{dG}{dt} \cdot t \quad \text{Eq. [13]}$$

Moreover, the Eq. [12] divided by t results in the slope of the injection rating.

According to the process as described just above, it is allowed to find the start-delay time spanning from the time when the injector is applied with an instruction to initiate the fuel injection to the time when the actual fuel injection starts. As a result, the initial quantity of fuel injected, the initial injection rating and the rate of change of the initial injection rating may be identified.

Now, the left part of the Eq. [7] represents the speed of lift of the needle valve 24, namely the speed with which the discharge orifices 25 are opened. With regard to the right part of the Eq. [7], all of the volume of the balance chamber, the volume modulus of fuel, the maximum area of the needle valve, the valve set area and the preset spring force are known, with the exception of the start-delay time T and the common rail pressure. However, the common rail pressure may be easily transmitted from the pressure sensor and consequently the speed of lift of the needle valve 24, namely, the initial quantity of fuel injected, may be found indirectly on the basis of the start-delay time T. This is fairly consistent with the experimental results of the initial injection rating obtained on the actual engine operation and shown in FIG. 4, in which the longer the start-delay time T is, the less is the initial injection rating, that is, the rate of change k of the initial injection rating, or the early portion of the injection rating q, is moderate in its slope.

Figure 4:
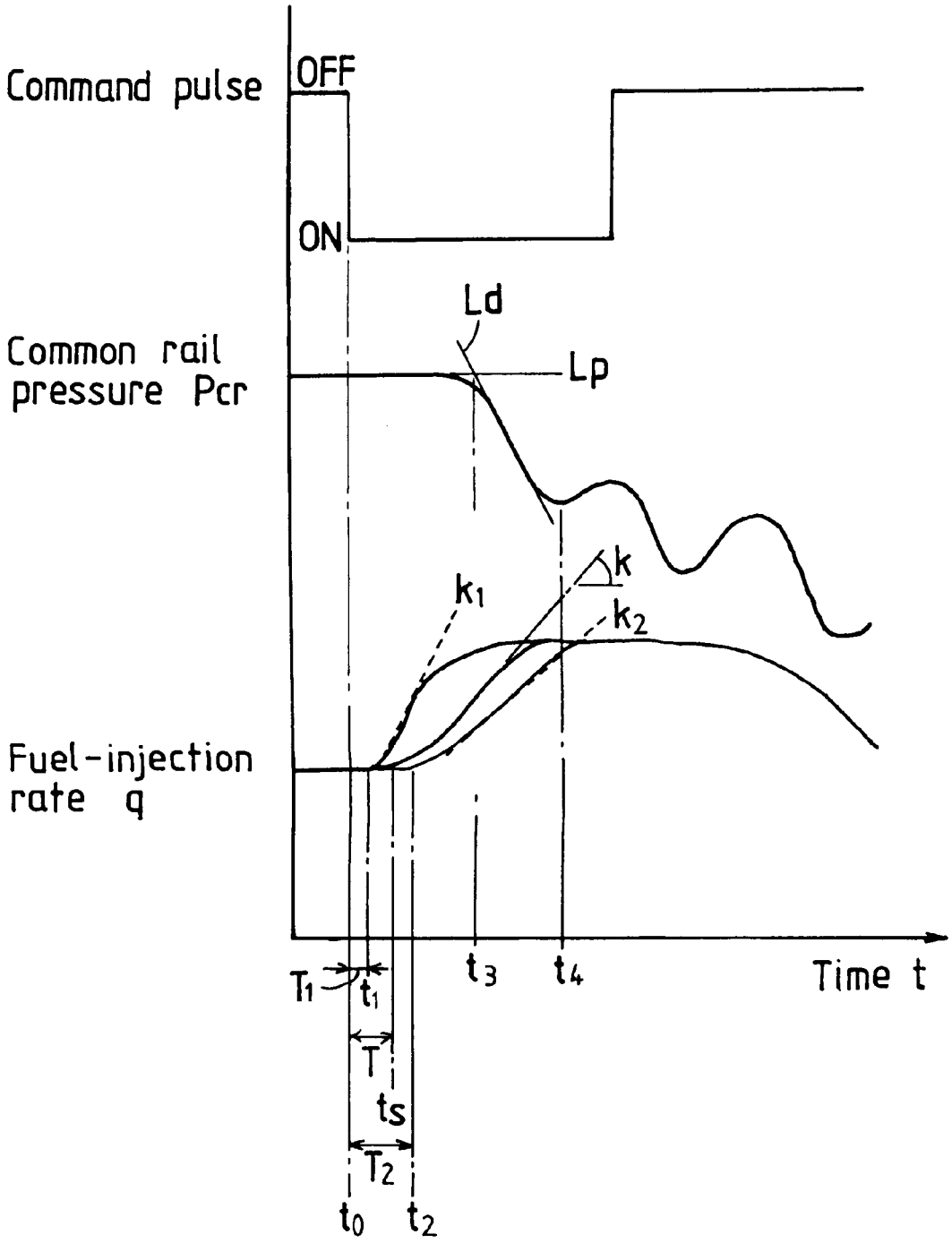
FIG. 4 is a composite graph of a common rail pressure, injection rating in response to an exciting pulse.

Referring to FIG. 4 showing a composite graph of the common rail pressure, and injection rating in response to the exciting pulse, a time $t_0$ when the command pulse falls is a time at which an instruction to initiate the fuel injection is applied to the injector 1, which in turn begins an actual fuel injection at a time $t_s$ after a lapse of the start-delay time T. It will be seen that the initial injection rating, or the early portion of the injection rating q, as well as the rate $k_1$ of change thereof become greater in value at a time $t_1$ for the actual fuel injection, or another start-delay time $T_1$ no later than the start-delay time T and, therefore, the quantity of fuel injected no later than a preselected length of time increases in proportion to the rate $k_1$ of change. In contrast, the initial injection rating as well as the rate $k_2$ of change thereof become less in value at a time $t_2$ for the actual fuel injection, or another start-delay time $T_2$ later than the start-delay time T and, therefore, the quantity of fuel injected later than a preselected length of time made less in proportion to the rate of change $k_2$. The start-delay time T is in a positive correlation with both the initial injection rating and the rate of change thereof, which is obtained by the previous experiments and stored in a ROM of the controller unit in the form of mapped data, which will be hereinafter referred to as mapped data.

In the meantime, disclosed in our co-pending senior patent application in Japan, Japanese Patent Laid-Open No. 101149/1999 is a method of finding the start-delay time T spanning from a command pulse fall to control the exciting signal applied to the actuator in the injector to the time for the initiation of the actual fuel injection. The method in our co-pending application will be explained with reference to FIG. 4. After finding an approximate straight line Ld of a curve in the range from the start of common-rail pressure drop owing to the fuel injection to a time $t_4$ at which the first minimal value appears, the timing for the start of common rail-pressure drop is defined at a time-coordinate $t_3$ where the approximate straight line Ld intersects with an approximate line Lp prior to the descending trend, which shows a mean pressure before the start of common-rail pressure drop. Based the mean common-rail pressure Lp before the start of the pressure drop and the timing $t_3$ for the start of the common-rail pressure drop, the start-delay time T spanning from the time $t_0$ for the command pulse fall to the time $t_s$ for the start of the fuel injection may be found in accordance with the functional relation, which has been obtained experimentally. In FIG. 4, the approximate descending straight line Ld is defined by a tangent at a point of inflection of the curve till the common-rail pressure Pcr reaches the first minimal value. As an alternative, the approximate straight line Ld may be an approximate straight line that may be obtained by least square method, for example, from a curve in the range from a preselected time before the start of the pressure drop in the common-rail pressure Pcr to the time at which the common-rail pressure becomes the first minimal value. In this alternative, the time for the start of the common-rail pressure drop is defined at the time when a deflection in pressure between the varying curve of the common-rail pressure and the approximate descending straight line becomes maximal.

Figure 1:
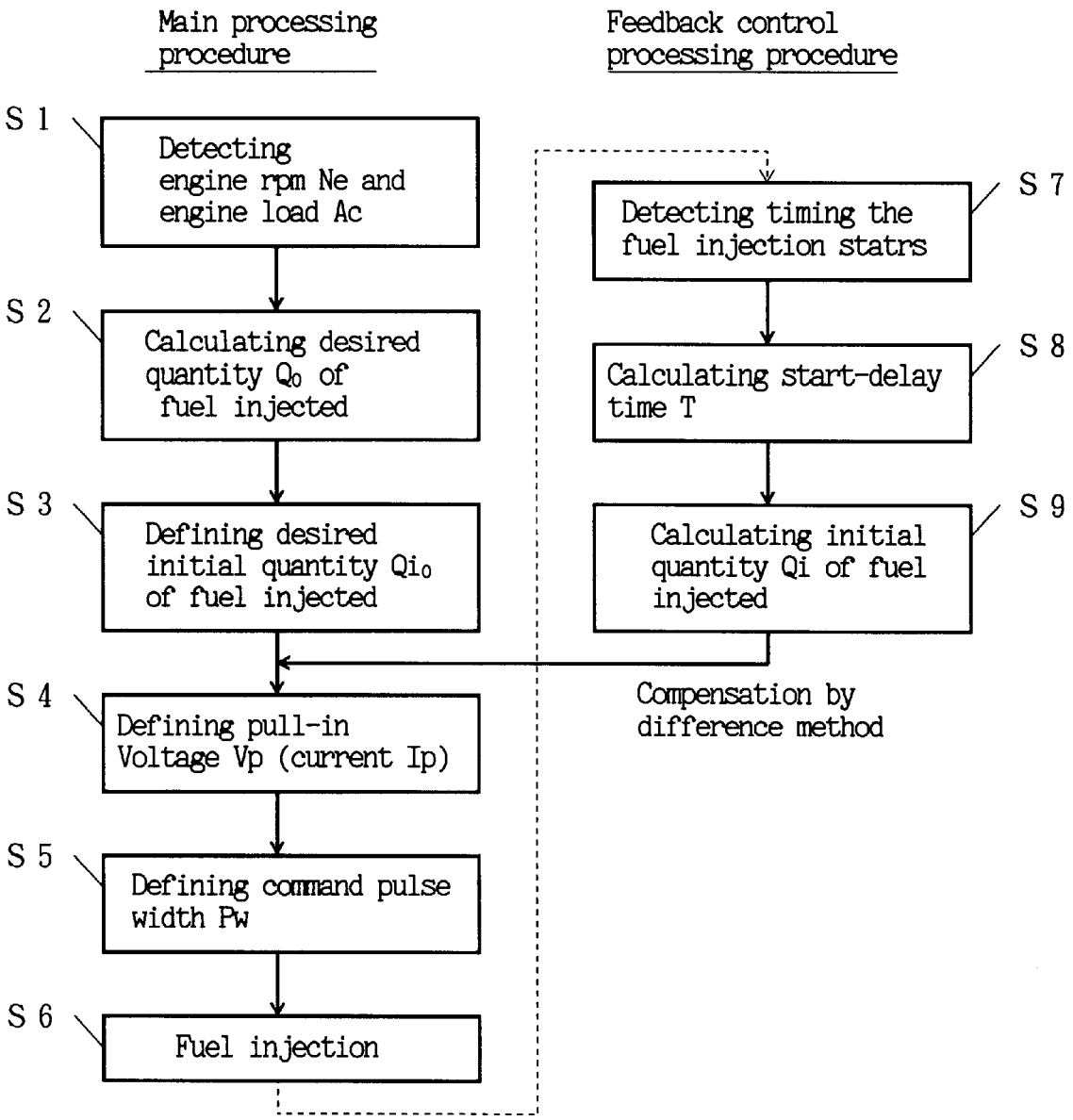
FIG. 1 is a flowchart showing a feedback control of controlled variables of an initial fuel injection in a common rail fuel-injection system according to the present invention.
Figure 2:
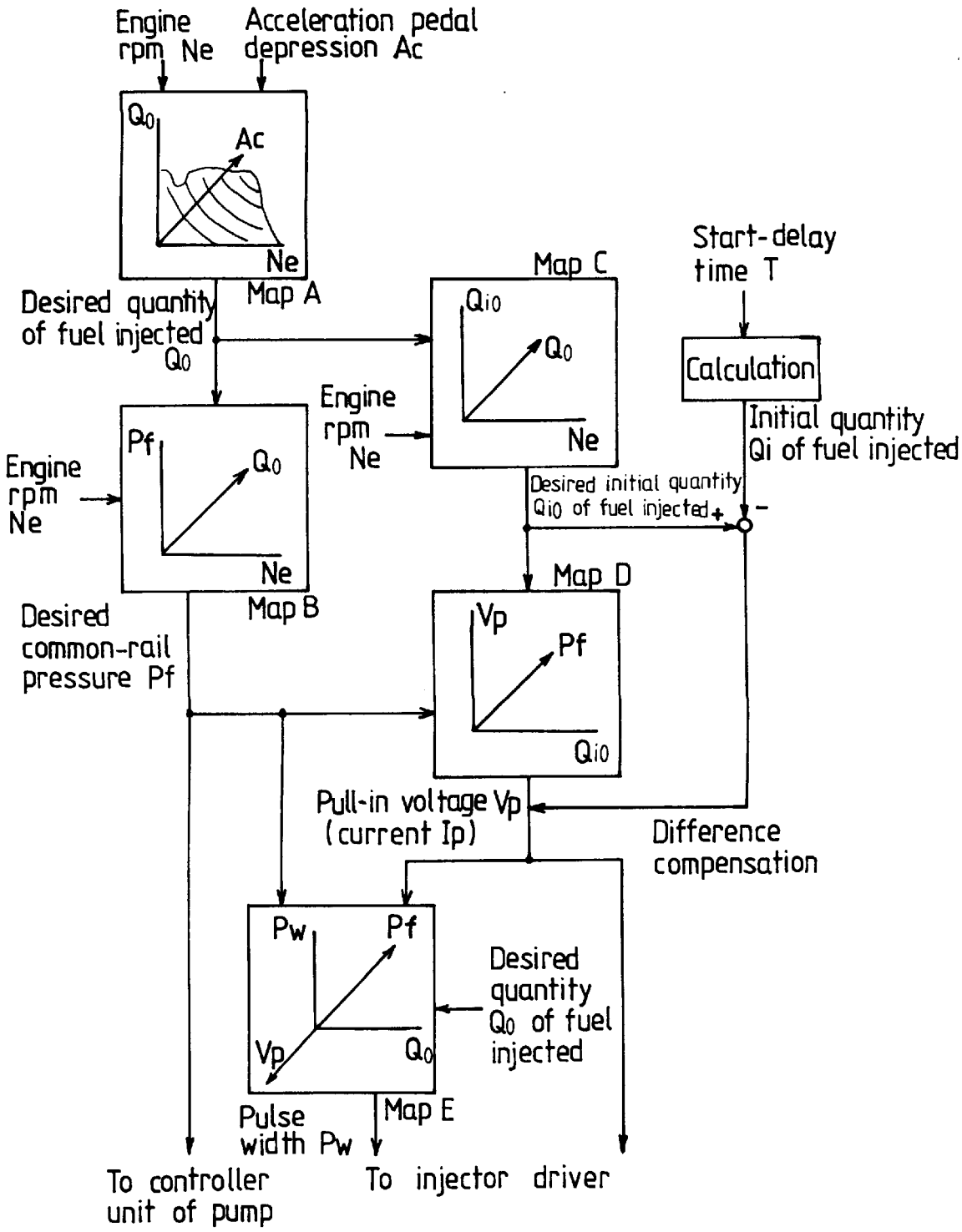
FIG. 2 is a block schematic diagram illustrating the feedback control of the controlled variables of an initial fuel injection shown in FIG. 1.

The fuel-injection system may be feedback controlled by making use of the controlled variables: the initial quantity of fuel injected, the initial injection rating and the rate of change of the initial injection rating, which are found dependent on the start-delay time T. Shown in FIGS. 1 and 2 is an example of the feedback control of the initial fuel injection in which the controlled variable at the initial fuel injection is the initial quantity of the fuel injected. The processing step in FIGS. 1 will be referred to as a letter "S" hereinafter. Sensors for monitoring include a tachometer monitoring the engine rpm and an accelerator pedal depression sensor monitoring the engine load. The engine rpm Ne and the engine load Ac are detected (S1). A desired quantity $Q_0$ of fuel injected, or a desired quantity of fuel injected during the overall duration of injection per cycle, is found, in compliance with the engine rpm Ne and the engine load Ac transmitted from the associated sensors, on a lookup map A in which is previously defined a correlation of the desired quantity $Q_0$ of fuel injected with the engine rpm Ne and the engine load Ac (S2). A desired common-rail pressure Pf is found on a lookup map B, which is also defined previously, in compliance with the engine rpm Ne and the desired quantity $Q_0$ of fuel injected, which has been found on the map A. The desired common-rail pressure Pf is signaled to the controller unit, which in turn controls both the high-pressure fuel pump 8 and the flow-rate control valve 14 to thereby make the desired common-rail pressure Pf of an actual common-rail pressure.

A lookup map C is previously defined, in which the correlation among the desired quantity $Q_0$ of fuel injected, the engine rpm Ne and a desired initial quantity $Qi_0$ is plotted with regard to smoke emission control and specific fuel consumption such event that it is not permitted to achieve the noise control or the exhaust gas circulation of the engine. A desired initial quantity $Qi_0$ is defined on the lookup map C in compliance with the desired quantity $Q_0$ calculated above and the engine rpm Ne detected (S3). Found on a lookup map D, which is also defined previously, is a magnitude of a pull-in voltage Vp or a pull-in current Ip that is applied to the actuator of the injector 1 thereby making the desired initial quantity $Qi_0$ of fuel injected, which is found at the (S3), of the initial quantity Qi of fuel injected (S4). The lookup map D corresponds to the second mapped data according to the present invention, in which the pull-in voltage Vp is found for the actuator of the piezoelectric elements while the pull-in current Ip is for the solenoid-operated actuator.

When taking into consideration the pull-in voltage Vp or current Ip found in the (S4), there is a possibility that the total quantity Q of fuel injected differs from the desired quantity $Q_0$ of fuel injected. To cope with this possibility, a command pulse width Pw making the quantity Q of fuel injected conform with desired quantity $Q_0$ of fuel injected is determined based on a three-dimensional lookup map E in which the desired quantity $Q_0$ of fuel injected, the command pulse width Pw and the pull-in voltage Vp or current Ip are plotted with the desired common-rail pressure Pf as a parameter (S5). The injector driver is energized with the pull-in voltage Vp or current Ip found at the (S4) and the command pulse of the pulse width Pw determined at the (S5) to carry out the actual fuel injection (S6). The lookup map E may be a two-dimensional map of the desired quantity $Q_0$ and the command pulse width Pw plotted in accordance with several pull-in voltages Vp or currents Ip.

Owing to the actual fuel injection of the injector at the (S6), as described above, the time when the actual fuel injection starts is detected based on the descending curve of the common-rail pressure (S7). The start-delay time T is calculated, which spans from the time of the command pulse fall to the time for the start of the fuel injection (S8). The actual initial quantity Qi of fuel injected is found, based on the start-delay time T (S9). That is to say, for instance, a lookup map shown in FIG. 3 corresponding to the mapped data of the present invention is previously defined, which illustrates the correlation of the start-delay time T with the actual initial quantity Qi of fuel injected, for example, the quantity of fuel injected during the duration of 0.5 msc from the start of the fuel injection. According to the mapped data, the actual initial quantity Qi of fuel injected may be found in correspondence to the start-delay time T.

Figure 3:
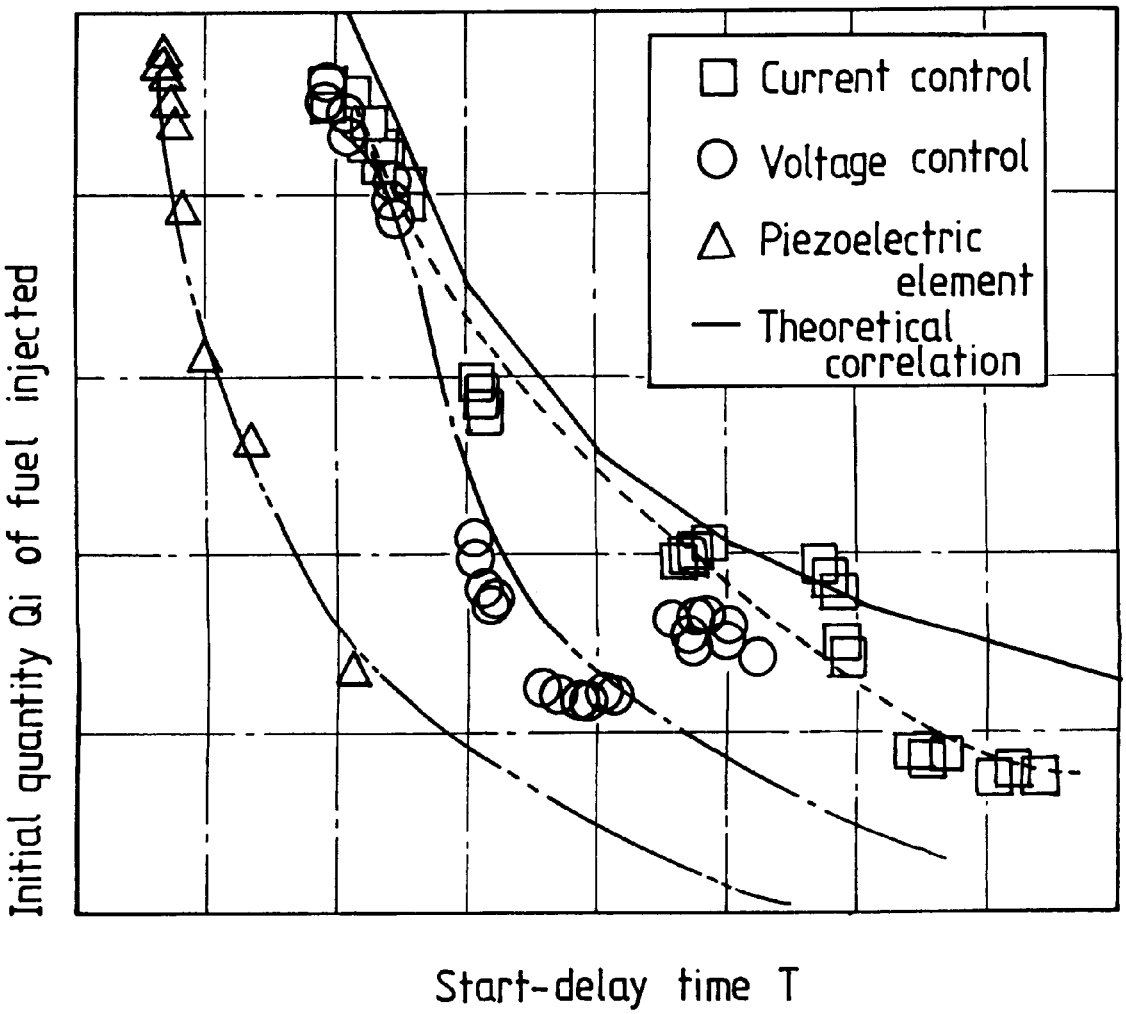
FIG. 3 is a graphic representation showing a correlation of a start time-delay with a quantity of initial fuel injection.

In accordance with a difference between the desired initial quantity $Qi_0$ of fuel injected found on the lookup map C at the (S3) and the actual initial quantity Qi found at (S9), namely, $(Qi_0-Qi)$, a correction value of the pull-in voltage Vp or current Ip is calculated, for example, by the proportional-plus-integral-plus-derivative control of the difference $(Qi_0-Qi)$. The pull-in voltage Vp or current Ip found on the map D is added with the correction value to be compensated and the consequent pull-in voltage Vp or current Ip causes the speed of opening of the valve 42, or the speed of lift of the needle valve 24, to alter thereby adjusting the initial quantity of fuel injected so as to render the differences $(Qi_0-Qi)$ zero. In FIG. 3, curves of voltage control and current control represent the control characteristic of the pull-in voltage and the control characteristic of pull-in current, respectively, in the actuator having the electromagnetic solenoid while a curve about the piezoelectric element represents the control characteristic of the voltage applied to the piezoelectric element used in the actuator. As will be understood from the characteristic curves, the electromagnetic solenoid is closer in the current control to the theoretical curve, compared with the voltage control and, therefore, the solenoid-operated actuator does not require voltage boosters, but may be made inexpensive by making use of comparators.

Having described the feedback control with reference to FIGS. 1 to 3, in which the initial quantity of fuel injected is adopted as the controlled variable of the initial fuel injection, it is believed obvious that the feedback control of the present invention may be fairly carried out by any one of the time-based differential of the initial quantity of fuel injected, or the initial injection rating, and the time-based differential of the initial fuel-injection rating, or the rate of change of the initial injection rating, instead of the initial quantity of fuel injected. In connection with FIG. 3, the controller unit may be alternatively stored with mapped data in which is plotted previously the correlation of the start-delay time T versus any one of the initial injection rating qi and the rate k of change of the initial injection rating, which has been experimentally obtained. In these alternatives, the lookup map C is a map defining a desired initial injection rating $qi_0$ or a rate $k_0$ of change of the desired initial injection rating in accordance with the desired quantity $Q_0$ of fuel injected and the engine rpm Ne, while the lookup map D is of a map defining the pull-in voltage Vp or current Ip dependent on the correlation between the common-rail pressure Pf and any one of the desired initial injection rating $qi_0$ or a rate $k_0$ of change of the desired initial injection rating.

Like the control of the initial quantity of fuel injected, detecting the start-delay time T results in finding the initial injection rating qi or the rate k of change of the initial injection rating. Consequently, the pull-in voltage Vp or current Ip is compensated by the difference method in compliance with the deflection between the initial injection rating qi or the rate k of change of the initial injection rating and the initial injection rating $qi_0$ or the rate $k_0$ of change of the initial injection rating, which is found on the map C.

According to the common-rail fuel-injection system of the present invention, the injection rating during the early portion of the injection duration, for example, for 0.5 msc from the start of the fuel injection, increases linearly as the time of injection proceeds and there is a mutually proportional correlation among the initial quantity of fuel injected at the early portion of the injection duration, the injection rating and the rate of change of the injection rating, so that the rate of change of the injection rating may be, for example, used as a parameter for control. This makes it possible to control the fuel injection in compliance with not only the quantity of fuel injected but also the injection rating and the rate of change of the injection rating. Moreover, relieving the fuel pressure in the balance chamber causes controlling the lift of the needle valve, namely, the injection rating and, therefore, it will be said the injection rating is controlled directly with the adjustment of the fuel pressure in the pressure-control chamber.

As this invention may be embodied in several forms without departing from the spirit of essential characteristics thereof, the present embodiment is therefore illustrative and not restrictive, since the scope of the invention is defined by the appended claims rather than by the description proceeding them, and all changes that fall within meets and bounds of the claims, or equivalence of such meets and bounds are therefore intended to embraced by the claims.

What is claimed is:

1. A common-rail fuel-injection system comprising, injectors for spraying fuel during successive cycles into combustion chambers of an engine, a common rail storing therein the fuel to be applied to the injectors, a high-pressure fuel pump for delivery of the fuel to the common rail, detecting means for monitoring engine operating conditions, and a controller unit for regulating fuel injection out of the injectors in compliance with signals transmitted from the detecting means, wherein each cycle of fuel injection has an initial time interval during which an initial quantity of fuel is injected, the controller unit stores therein mapped data of a correlation defined previously between a controlled variable of the fuel injection at the initial time interval of each cycle and a start-delay time that spans from a time any one of the injectors is applied with an instruction to initiate the fuel injection to a time an actual fuel injection starts at the injector, finding on the first mapped data the controlled variable of the fuel injection at the initial time interval in compliance with the start-delay time, finding a desired, controlled variable of the fuel injection at the initial time interval dependent on the signals, whereby the fuel injection out of the injector is controlled such that the controlled variable of the fuel injection is made to conform to the desired, controlled variable of the fuel injection.

2. A common-rail fuel-injection system constructed as defined in claim 1, wherein the controlled variable and the desired, controlled variable of the fuel injection at the initial time interval are an initial quantity of fuel injected and a desired, initial quantity of fuel injected, respectively.

3. A common-rail fuel-injection system constructed as defined in claim 1, wherein the controlled variable and the desired, controlled variable of the fuel injection at the initial time interval are an initial injection rating and a desired, initial injection rating, respectively.

4. A common-rail fuel-injection system constructed as defined in claim 1, wherein the controlled variable and the desired, controlled variable of the fuel injection at the initial injection are a rate of change of the initial injection rating and a desired rate of change of the initial injection rating, respectively.

5. A common-rail fuel-injection system constructed as defined in claim 1, wherein the start-delay time is determined by a correlation that is defined previously between a fuel pressure in the common rail before a pressure drop owing to the fuel injection and a time when the fuel pressure in the common rail starts descending.

6. A common-rail fuel-injection system constructed as defined in claim 5, wherein the timing the fuel pressure in the common rail starts descending is found, on a graphic representation showing a correlation between a length of time from the start till the end of the fuel injection and the fuel pressure in the common rail during the length of time, at a time-coordinate where an approximate descending straight line of the common-rail fuel pressure falling owing to the fuel injection intersects with an approximate line of the common-rail fuel pressure before the start of common-rail fuel pressure drop.

7. A common-rail fuel-injection system constructed as defined in claim 5, wherein the timing the fuel pressure in the common rail starts descending is found, on a graphic representation showing a correlation between a length of time from the start till the end of the fuel injection and the fuel pressure in the common rail during the length of time, at a time-coordinate where a deflection in pressure between the approximate descending straight line of the common-rail fuel pressure falling owing to the fuel injection and the varying curve of the common-rail fuel pressure becomes maximal.

8. A common-rail fuel-injection system constructed as defined in claim 1, wherein the injectors each includes a balance chamber applied with a part of the fuel fed from the common rail, a needle valve movable upward and downward, depending on a hydraulic action of the fuel in the balance chamber, to thereby open and close discharge orifices at a distal end of the injector, a valve for allowing the fuel to discharge out of the balance chamber thereby resulting in relieving the fuel pressure in the balance chamber, and an actuator for driving the valve, and wherein the actuator is energized with an exciting signal responding to a command pulse issued from the controller unit to instruct the start of the fuel injection.

9. A common-rail fuel-injection system constructed as defined in claim 8 wherein the actuator is composed of any one of electromagnetic solenoid and piezoelectric element, the exciting signal to operate the actuator is any one selected from any one of an electric current and a voltage applied to the solenoid and a voltage applied to the piezoelectric element, and the controller unit stores therein a second mapped data of a correlation defined previously among the common-rail fuel pressure, the desired, controlled variable of the fuel injection at the initial fuel injection and the any one of the current and voltage, whereby any one of the current and voltage is calculated on the second mapped data in compliance with the common-rail fuel pressure and the desired, controlled variable of the fuel injection.

10. A common-rail fuel-injection system constructed as defined in claim 9 wherein the controller unit compensates any one of the current and the voltage, which is found by calculation on the second mapped data, based on a deflection between the desired, initial controlled variable at the initial fuel injection and the initial controlled variable at the initial fuel injection found on the mapped data in compliance with the start-delay time.

11. A common-rail fuel-injection system constructed as defined in claim 9 wherein the controller unit stores therein a third mapped data of a correlation defined previously among a desired quantity of fuel injected, which is found in accordance with the signals from the detecting means, the common-rail fuel pressure, any one of the current and voltage and a pulse width of the command pulse, whereby the command pulse width is calculated in compliance with the common-rail fuel pressure on the third mapped data and any one of the current and voltage found on the second mapped data, to thereby achieve the desired quantity of fuel injected.

* * * * *